US006009628A

United States Patent [19]

Mizushima

[11] Patent Number: 6,009,628

[45] Date of Patent: Jan. 4, 2000

[54] TRIPLE PROJECTION SURFACE SUNDIAL

[76] Inventor: Masataka Mizushima, 523 Theresa Dr., Boulder, Colo. 80303

[21] Appl. No.: 08/986,252

[22] Filed: Dec. 5, 1997

Related U.S. Application Data

[60] Provisional application No. 60/059,782, Sep. 23, 1997.

[51] Int. Cl.[7] ..... G04B 49/04

[52] U.S. Cl. ..... 33/270

[58] Field of Search ..... 33/269, 270, 271

[56] References Cited

U.S. PATENT DOCUMENTS

| | | | |
|---|---|---|---|
| 78,133 | 5/1868 | Risch | 33/271 |
| D. 382,821 | 8/1997 | Zurfluh | 33/270 |
| 2,463,781 | 3/1949 | Lawrence | 33/271 |
| 3,616,538 | 11/1971 | Yabashi | 33/270 |
| 4,081,911 | 4/1978 | Eldridge | 33/270 |
| 4,237,611 | 12/1980 | Wurch et al. | 33/271 |
| 4,656,478 | 4/1987 | Thual | 33/270 |
| 4,835,875 | 6/1989 | Fuller | 33/270 |
| 4,845,853 | 7/1989 | Haskett | 33/270 |
| 4,890,269 | 12/1989 | Buckner et al. | 33/270 |
| 4,922,619 | 5/1990 | Singleton | 33/270 |
| 4,924,592 | 5/1990 | Fuller | 33/270 |
| 4,945,644 | 8/1990 | Fuller | 33/270 |
| 5,062,212 | 11/1991 | Blaker | 33/270 |
| 5,197,199 | 3/1993 | Shrader | 33/269 |
| 5,425,178 | 6/1995 | Steele | 33/271 |
| 5,596,553 | 1/1997 | Kellogg | 33/270 |

*Primary Examiner*—G. Bradley Bennett
*Attorney, Agent, or Firm*—Swanson & Bratschun LLC

[57] ABSTRACT

The present invention is a sundial having first and second spaced parallel planar projection surfaces, the first projection surface defining a summer projection surface and the second projection surface defining a winter projection surface. A gnomon extends perpendicularly between the summer and winter projection surfaces. The gnomon is positioned relative to the summer and winter projection surfaces so that with the sundial in an operative alignment with the parallel projection surfaces parallel to the equatorial plane of the earth, on sunny days a shadow is cast by the gnomon on the summer projection surface during those days when the sun rises above the equatorial plane in the northern hemisphere and a shadow is cast by the gnomon on the winter projection surface during those days when the sun does not rise above the equatorial plane in the northern hemisphere.

13 Claims, 2 Drawing Sheets

TRIPLE PROJECTION SURFACE SUNDIAL

This application claims the benefit of U.S. Provisional No. 06/059,782 filed Sep. 23, 1997.

BACKGROUND OF THE INVENTION

1. Technical Field

The present invention is directed to sundials, and more particularly toward a sundial for accurately and conveniently displaying time during the summer and winter months and for indicating the date.

2. Background Art

Sundials are devices that show the time by the sun producing a shadow on a marked surface. Sundials have been known for thousands of years, with one of the earliest examples being a horizontal bar of about one foot in length with a T-shaped structure at one end that existed in Egypt about 1500 BC. The length of the shadow cast by the T-shaped structure on the horizontal bar gave the time. Also known for hundreds of years are sundials with a horizontal projection surface and vertical gnomon for producing a shadow on the horizontal projection surface as the sun moves across the sky. One significant problem with such structures is that as the sun moves from east to west in the sky, the shadow moves at different rates along the horizontal projection surface, requiring uneven spacing of the indicia of time. In a more advanced version of such a sundial, the planar tracing surface is made parallel to the equatorial plane so that the shadow advances at a constant rate, allowing the markings on the planar projection surface to be constantly spaced, which improves the ease of telling time. The gnomon on such a structure is placed at the latitude angle with respect to a local horizontal plane.

Even this more advanced version of the sundial has serious shortcomings. Most notably, the sundial typically displays the time in a manner that is convenient to read during the summer months. In the winter months, with the sun dipping below the equatorial plane, the display of time is less convenient to observe. In addition, these conventional sundial structures do not provide indication of the date.

The present invention is directed to overcoming one or more of these deficiencies.

SUMMARY OF THE INVENTION

The first aspect of the present invention is a sundial having first and second spaced parallel planar projection surfaces, the first projection surface defining a summer projection surface and the second projection surface defining a winter projection surface. A gnomon extends perpendicularly between the summer and winter projection surfaces. The gnomon is positioned relative to the summer and winter projection surfaces so that with the sundial in an operative alignment with the parallel projection surfaces parallel to the equatorial plane of the earth, on sunny days a shadow is cast by the gnomon on the summer projection surface during those days when the sun rises above the equatorial plane in the northern hemisphere and a shadow is cast by the gnomon on the winter projection surface during those days when the sun does not rise above the equatorial plane in the northern hemisphere. The sundial may further include time indicia on each of the summer and winter projection surfaces, the time indicia being arranged relative to the gnomon so that with the sundial in the operative alignment, the time of day is indicated by the shadow striking a particular time indicia. The sundial may further include an arcuate wall extending perpendicularly between the summer and winter projection surfaces and spaced radially from the gnomon. The arcuate wall terminates to define an opening with the gnomon disposed within the opening. The interior of the arcuate wall defines an arcuate projection surface. The opening faces south with the sundial in the operative alignment. A marker may be provided on the gnomon intermediate the summer and winter projection surfaces. Date indicia are then provided on the arcuate projection surface, the date indicia being arranged relative to the gnomon so that with the sundial in its operative alignment, the marker casts a shadow on a particular date indicia indicating the date. The summer and winter projection surfaces are preferably rotatable relative to one another about the gnomon to enable calibration of the sundial for standard and daylight savings time.

A second aspect of the present invention is a sundial including a first planar projection surface and a gnomon extending perpendicularly from the first planar projection surface. The gnomon includes a marker intermediate its proximal and distal ends. An arcuate wall defining an arcuate projection surface extends normally from the first planar projection surface. The arcuate wall terminates to define an opening with the gnomon disposed within the opening. The sundial has an operative alignment wherein the first planar projection surface is parallel to the equatorial plane of the earth and the opening faces due south. In this manner, the shadow cast by the gnomon on the first planar projection surface indicates the time of day and the shadow cast by the marker on the arcuate projection surface indicates the date. Indicia corresponding to the time and date may be provided on the first planar projection surface and the arcuate projection surface.

A third aspect of the present invention is a method of telling the time and date. A sundial including first and second spaced planar projection surfaces is provided. The first projection surface defines a summer projection surface and the second projection surface defines a winter projection surface. A gnomon extends perpendicularly between the summer and winter projection surfaces. The gnomon has a marker intermediate the summer and winter projection surfaces. An arcuate wall extends perpendicularly between the summer and winter projection surfaces and is spaced radially from the gnomon. The arcuate wall terminates to define an opening with the gnomon disposed within the opening. The interior of the arcuate wall defines an arcuate projection surface. The sundial is positioned in operative alignment with the summer and winter projection surfaces parallel to the equatorial plane of the earth and the opening facing due south. In this manner, on sunny days a shadow is cast by the gnomon on the summer projection surface during those days when the sun rises above the equatorial plane in the northern hemisphere and a shadow is cast by the gnomon on the winter projection surface during those days when the sun does not rise above the equatorial plane in the northern hemisphere. A shadow is cast by the marker on the arcuate projection surface which corresponds to the date. Indicia may be provided on the planar projection surfaces corresponding to the time of day when the indica is struck by the shadow cast by the gnomon and indica may be provided on the arcuate projection surface corresponding to the date the indicia is struck by a shadow cast by the marker.

The sundial of the present invention provides for convenient and accurate display of the time on a year round basis. In addition, the inventive sundial provides for ready observation of the date. The sundial may be quickly and easily constructed from readily available materials, therefore providing these many advantages at a minimal cost.

DETAILED DESCRIPTION OF THE PREFERRED EMBODIMENT

Figure 1:
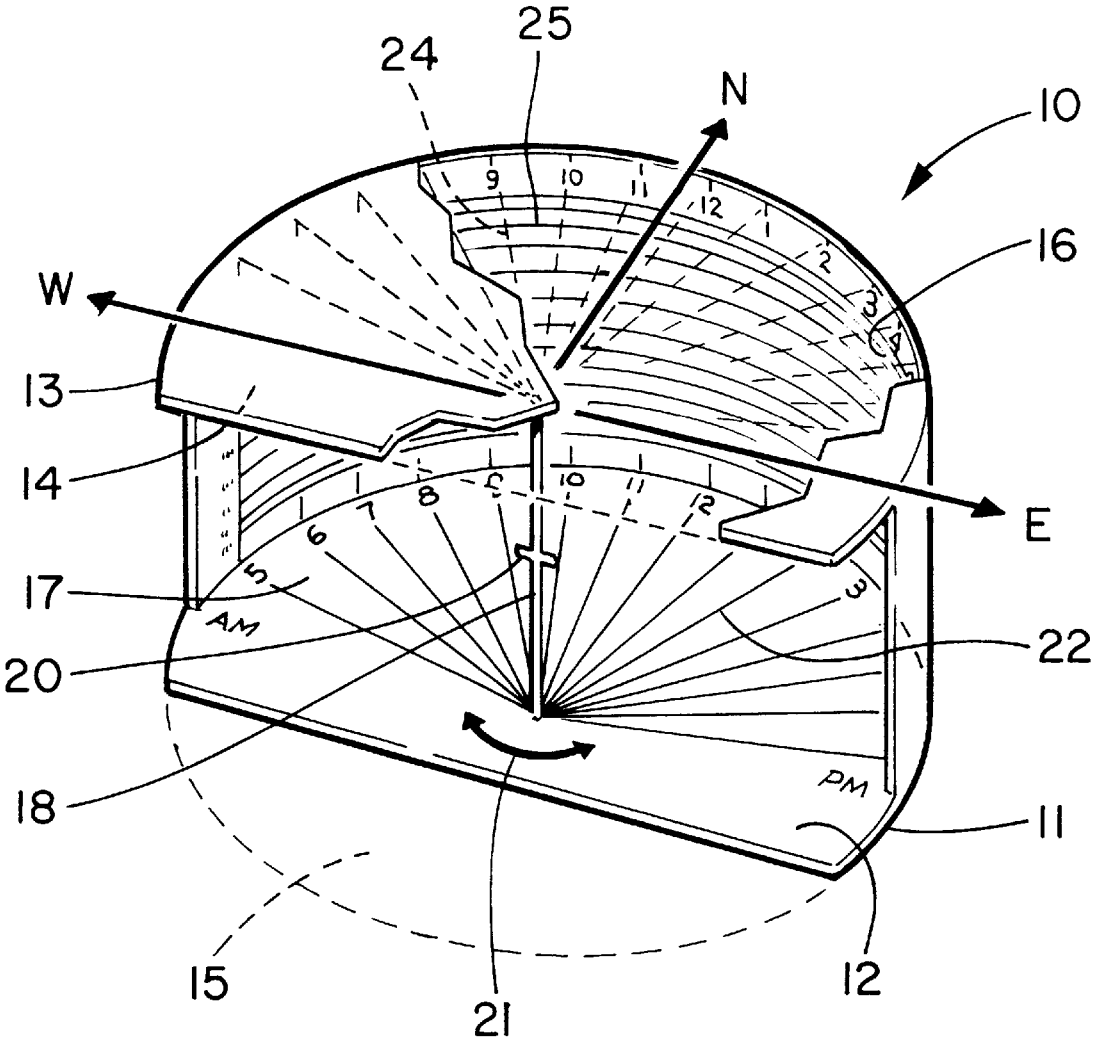
FIG. 1 is a perspective view of the sundial structure with the south facing or winter planar surface shown partially cut away for clarity.

The triple projection surface sundial 10 is shown in perspective view in FIG. 1. The triple projection surface sundial 10 consists of a bottom 11 having a north facing or summer surface 12 and a top 13 having a south facing or winter surface 14 which is shown partially cut away in FIG. 1. The bottom and top 11, 13 and therefore the winter and summer surfaces 12, 14 are substantially circular in configuration with a truncated portion 13 shown with regard to the summer surface 12 in phantom lines in FIG. 1. The surfaces are planar and parallel to one another. An arcuate wall defining an arcuate projection surface 15 joins the periphery of the summer and winter surfaces 12, 14 and extends perpendicularly between the surfaces 12, 14, leaving an opening 17 at the truncated portion. From a plan view, the wall corresponds in shape to an extended semicircle. A projection rod or gnomon 18 extends between the summer and winter surfaces 12, 14 perpendicular to the summer and winter surfaces 12, 14 at what would be the center of the surfaces were they complete circles. The gnomon 18 includes a marker 20 midway between the summer and winter surfaces 12, 14. Preferably, the summer and winter projection planes are made to be rotatable relative to one another about the gnomon, as indicated by the arrow 21.

The summer surface 12 includes a number of equally spaced radial indica 22 corresponding to daylight hours. Further indica indicating segments of the hour such as minutes and even seconds could further be included, depending upon the size of the surface. Several indica are also indicated in phantom lines at 24 on what would be the winter surface 14. As indicated in FIG. 1, these indicia preferably extend on the arcuate projection surface to ensure time can be read during the semi-annual equinox.

The arcuate projection surface 16 includes date indica 25. The very top of the arcuate projection surface corresponds to the winter solstice, December $22^{nd}$ or $21^{st}$ in the northern hemisphere. The bottom of the arcuate projection surface corresponds to the summer solstice, June $22^{nd}$ or $21^{st}$ in the northern hemisphere. The indicia 25 consisting of a number of lines parallel to the summer and winter surfaces 12, 14 are preferably included on the arcuate projection surface and correspond to dates between the summer and winter solstices. Those skilled in the art will recognize that because the sun does not appear to rise and fall at a constant rate relative to the equatorial plane, these indicia will not be evenly spaced for equal day increments. Deriving the proper location of the indicia is readily accomplished in use by means of a standard calendar and observation of the location of the marker shadow on the arcuate projection surface 16 on a given date.

Figure 2:
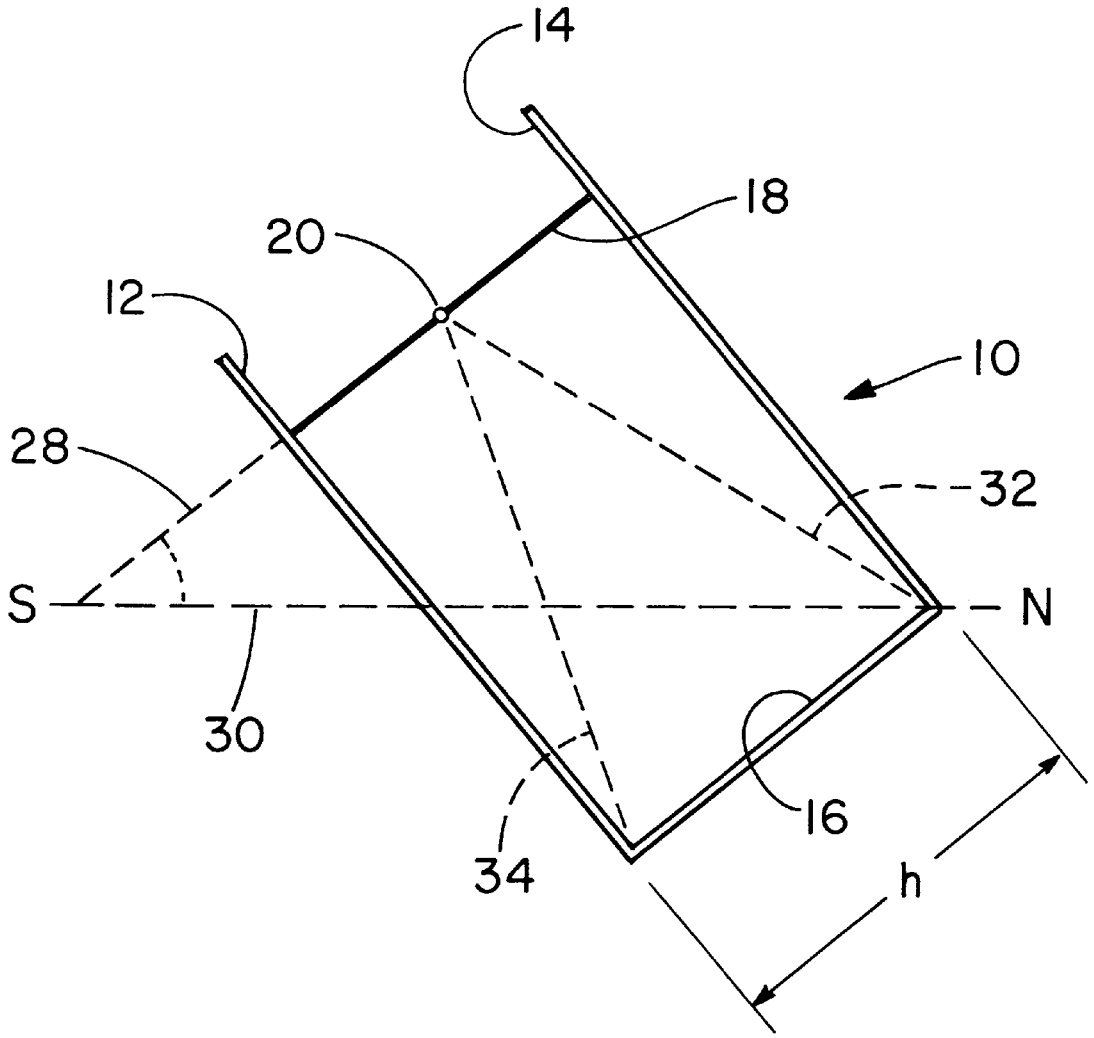
FIG. 2 is a side sectional view of the sundial of FIG. 1 illustrating its proper alignment.

FIG. 2 illustrates the orientation or alignment of the triple projection surface sundial. The sundial 10 is to be oriented in operative alignment with the winter and summer planar surfaces parallel to the equatorial plane. This can be readily accomplished by setting the gnomon 18 at the local latitude angle 28 with respect to a horizontal plane 30 at the site of set up. During standard time the hourly indicia on the summer and winter projection surfaces would both have 12 noon directed due north and the opening facing due south, as illustrated in FIG. 1. During daylight savings time, the summer surface would be rotated so that the 1 p.m. indicia faced due north.

Again referring to FIG. 2, the arcuate projection surface 16 is configured to receive a shadow from the marker 20. In order that the shadow from the marker 20 can move between the very top and bottom of the arcuate projection surface 16, the projection surface 16 must be of a height h equal to 2 l tan(23.44°), where l is the radius of the semicircle. Of course, this is a minimum for the height h and the height may be greater than 2 l tan(23.44°), although then the shadow projected by the marker 20 at the winter and summer solstices will not correspond to the top and bottom of the arcuate projection surface 16. The 23.44° angle corresponds to the angle the sun appears to move above and below the equatorial plane on the summer and winter solstices. Although not shown, an adjustable stand could be provided to help maintain the proper orientation of the sundial.

While the invention does not require the arcuate projection surface to extend any particular distance around the periphery of the planar surfaces, the arcuate projection surface should not extend so far around the periphery that it blocks the sun from striking the gnomon at either sunrise or sunset when the triple projection surface sundial is aligned in an operative orientation as discussed below.

In use, the sundial must be calibrated for the location at which it is to be deployed. As described above, the first calibration must be to make the gnomon 18 at the angle of the local latitude with respect to a horizontal planar surface. The planar projection surfaces are then aligned with the 12 noon indicia directed to actual (not magnetic) northN. During daylight savings time, the bottom of the summer surface would be rotated about the gnomon so that 1 p.m. is facing due north. Of course, in those areas where there is no daylight savings time, such an adjustment would not have to be made. Next, the sundial must be calibrated for the east-west location relative to the center of the time zone. For Denver (at 105.0° west, the appropriate center of the mountain time zone) noon for the winter surface would be almost exactly north. For Grand Junction (at 106.5° west), however, the bottom of the surfaces12, 14 should be adjusted to account for the time actually being six minutes after "noon" with the sun at its highest point in the sky at that point in the mountain time zone. The correction is 1 hour/15° of longitudinal deviation from the center of the time zone. East of the longitudinal center of the time zone one subtracts 1 hr/15° while west of the longitudinal center of the time zone one adds 1 hr/15°.

With the sundial thus aligned, during those days where the sun rises above the equatorial plane in the northern hemisphere, the shadow from the gnomon will be projected on the summer surface 12. Using the indicia 22, a user may quickly identify the time accurately. During the winter months in the northern hemisphere, with the sun lying below the equatorial plane, the shadow of the gnomon will be projected upon the winter surface 14. Again, using the indicia 24, the time can be accurately derived in a convenient manner simply by looking in the opening into the sundial. A further advantage of the triple projection surface sundial 10 is that the date will be projected on the arcuate projection surface 16 by the marker 20. Again referring to FIG. 2, the phantom line 32 represents the shadow projection from the marker on the winter solstice, December $22^{nd}$. The phantom line 34 represents the shadow projection from the marker on the summer solstice, June $22^{nd}$. As the sun moves between these extremes and then back again, the shadow from the marker will move up and down the arcuate projection surface 16. By including indicia 24 as illustrated in FIG. 1, the date can be derived.

The triple projection surface sundial can be easily constructed from readily available conventional materials and thus made available at a minimum of expense. It enables easy, convenient observation of time during either the winter or summer months from the same vantage point. The triple projection surface sundial is perfect for use by children as an educational tool as they can construct the sundial, properly calibrate it for their geographic location and then both study time and get a feel for concepts such as the fact that the earth rotates about a tilted axis and therefore as the earth rotates around the sun, the sun appears to move up and down in the sky.

The invention also has a significant scientific utility for telling absolute time because time is ultimately defined in terms of the earth's position relative to the sun. The triple projection surface sundial could be built to a scale to provide an absolute measurement of time provided the projection surfaces are large enough and the shadow conveyed by the gnomon could be sharp enough. Even the atomic clock at the National Institute for Standards and Technology located in Boulder, Colo., has to be adjusted for a leap second every year to keep the clock consistent with solar time.

What is claimed is:

1. A sundial comprising:

first and second spaced, parallel, planar projection surfaces, the first projection surface defining a summer projection surface and the second projection surface defining a winter projection surface; and a gnomon extending perpendicularly between the summer and winter projection surfaces, the gnomon being positioned relative to the summer and winter projection surfaces so that with the sundial in an operative alignment with the parallel projection surfaces parallel to the equatorial plane of the earth, on sunny days a shadow is cast by the gnomon on the summer projection surface during those days when the sun rises above the equatorial plane in the northern hemisphere and a shadow is cast by the gnomon on the winter projection surface during those days when the sun does not rise above the equatorial plane in the northern hemisphere.

2. The sundial of claim 1 further comprising time indicia on each of the winter and summer projection surfaces, the time indicia being arranged relative to the gnomon so that with the sundial in the operative alignment, the time of day is indicated by the shadow striking a particular time indicia.

3. The sundial of claim 1 further comprising an arcuate wall extending perpendicularly between the winter and summer projection surfaces and spaced radially from the gnomon, the arcuate wall terminating to define an opening with the gnomon disposed within the opening, the interior of the arcuate wall defining an arcuate projection surface and the opening facing south with the sundial in the operative alignment.

4. The sundial of claim 3 wherein the arcuate wall is an extended semicircle and the gnomon is at the axis of the extended semicircle, the extended semicircle having a radius of l and a height of at least 2l tan(23.44°).

5. The sundial of claim 4 further comprising:

a marker on the gnomon intermediate the winter and summer projection surfaces; and date indicia on the arcuate projection surface, the date indicia being arranged relative to the gnomon so that with the sundial in its operative alignment, the marker casts a marker shadow on a date indicia indicating the date.

6. The sundial of claim 1 wherein the winter and summer projection surfaces are rotatable relative to each other about the gnomon to enable calibration of the sundial for standard and daylight savings time.

7. The sundial of claim 3 wherein the arcuate wall terminates to define an opening sufficiently wide that a shadow is cast by the gnomon upon the winter or summer projection surfaces during all daylight hours.

8. The sundial of claim 1 wherein the arcuate wall is in an extended semicircle with the gnomon disposed at the axis of the extended semicircle.

9. A sundial comprising:

a first planar projection surface;

a gnomon extending perpendicularly from the first planar projection surface, the gnomon having a marker intermediate its proximal and distal ends; and an arcuate wall defining an arcuate projection surface extending normally from the first planar projection surface, the arcuate wall terminating to define an opening with the gnomon disposed within the opening, the sundial having an operative alignment wherein the first planar projection surface is parallel to the equatorial plane of the earth and the opening faces due south, whereby the shadow cast by the gnomon on the first planar projection surface indicates the time of day and the shadow cast by the marker on the arcuate projection surface indicates the date.

10. The sundial of claim 9 further comprising indicia on the first planar projection surface which corresponds to the time of day when struck by the shadow of the gnomon and indicia on the arcuate projection surface which corresponds to the date when struck by the shadow of the marker with the sundial in the operative alignment.

11. The sundial of claim 9 further comprising a second planar projection surface disposed facing and parallel to the first planar projection surface, the gnomon and the arcuate wall joining the first and second planar projection surfaces, whereby with the sundial in the operative position, the first planar surface defines a summer projection surface upon which a shadow of the gnomon is cast on sunny days when the sun rises above the equatorial plane in the northern hemisphere and the second planar surface defines a winter projection surface upon which a shadow of the gnomon is cast on sunny days when the sun does not rise above the equatorial plane in the northern hemisphere.

12. A method of telling the time and date comprising:

a. providing a sundial comprising first and second, spaced planar projection surfaces, the first projection surface defining a summer projection surface and the second projection surface defining a winter projection surface, a gnomon extending perpendicularly between the summer and winter projection surfaces, the gnomon having a marker intermediate the summer and winter projection surfaces and an arcuate wall extending perpendicularly between the winter and summer projection surfaces and spaced radially from the gnomon, the arcuate wall terminating to define an opening with the gnomon disposed within the opening, the interior of the arcuate wall defining an arcuate projection surface; and b. positioning the sundial in an operative alignment with the winter and summer projection surfaces parallel to the equatorial plane of the earth and the opening facing due south, whereby on sunny days a shadow is cast by the gnomon on the summer projection surface during those days when the sun rises above the equatorial plane in the northern hemisphere and a shadow is cast by the gnomon on the winter projection surface during those days when the sun does not rise above the equatorial plane in the northern hemisphere, the position of the shadow corresponding to the time of day, and a shadow is cast by the marker upon the arcuate projection surface corresponding to the date.

13. The method of claim 12 further comprising:

c. providing time indicia on the planar projection surfaces corresponding to the time of day when the indica is struck by the shadow cast by the gnomon and providing date indicia on the arcuate surface corresponding to the date the indicia is struck by the shadow cast by the marker.

* * * * *